US007367663B2

(12) United States Patent
Matsumoto

(10) Patent No.: US 7,367,663 B2
(45) Date of Patent: May 6, 2008

(54) LIQUID CONTAINER HAVING A STIRRING CHAMBER

(75) Inventor: Hitoshi Matsumoto, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 251 days.

(21) Appl. No.: 11/075,316

(22) Filed: Mar. 8, 2005

(65) Prior Publication Data

US 2005/0237368 A1 Oct. 27, 2005

(30) Foreign Application Priority Data

Mar. 10, 2004 (JP) ..... 2004-067789

(51) Int. Cl.
*B41J 2/175* (2006.01)

(52) U.S. Cl. ..... 347/86; 347/85

(58) Field of Classification Search ..... 347/86, 347/85; 222/211

See application file for complete search history.

(56) References Cited

U.S. PATENT DOCUMENTS

| | | | | |
|---|---|---|---|---|
| 3,240,399 | A * | 3/1966 | Frandeen | 222/211 |
| 4,558,326 | A | 12/1985 | Kimura et al. | |
| 7,118,204 | B2 * | 10/2006 | Hatasa et al. | 347/86 |
| 2001/0024225 | A1 * | 9/2001 | Ishizawa et al. | 347/86 |

FOREIGN PATENT DOCUMENTS

| | | | |
|---|---|---|---|
| DE | 102 27 225 | | 1/2004 |
| DE | 10227225 | * | 1/2004 |
| DE | 202004014373 | * | 12/2004 |
| JP | 57-024283 | A | 2/1982 |
| JP | 59-059457 | A | 4/1984 |
| JP | 60-110458 | A | 6/1985 |
| JP | 11-010902 | A | 1/1999 |
| JP | 2002-166566 | A | 6/2002 |
| JP | 2002-200767 | A | 7/2002 |

* cited by examiner

*Primary Examiner*—Stephen Meier
*Assistant Examiner*—Carlos A. Martinez, Jr.
(74) *Attorney, Agent, or Firm*—Stroock & Stroock & Lavan LLP

(57) ABSTRACT

A liquid container includes a liquid pack having a flexible pouch holding the liquid, a container body containing the liquid pack, an expandable-and-contractile stirring chamber formed in the container body, and a pressurized fluid supply passage for supplying a pressurized fluid into the stirring chamber. At least a part of the stirring chamber is formed of a low-rigidity member. A pressurized fluid is supplied through the pressurized fluid supply passage into the stirring chamber to press and deform the low-rigidity member by the pressure of the pressurized fluid. The deformed low-rigidity member presses and deforms the flexible pouch of the liquid pack. The liquid container prevents the uneven distribution of ingredient concentration in the liquid contained in the liquid container without complicating and enlarging a liquid-consuming apparatus.

15 Claims, 13 Drawing Sheets

LIQUID CONTAINER HAVING A STIRRING CHAMBER

CROSS REFERENCE TO RELATED APPLICATIONS

This application is based upon and claims the benefit of priority from the prior Japanese Patent Application No. 2004-67789, the entire contents of which are incorporated herein by reference.

BACKGROUND OF THE INVENTION

1. Technical Field

The present invention relates to a liquid container for holding a liquid to be supplied to a liquid-consuming apparatus.

2. Description of the Related Art

A liquid-ejecting apparatus provided with an ejecting head that ejects a liquid is a representative conventional liquid-consuming apparatus. An ink-jet recording apparatus provided with an ink-jet recording head for recording images is a typical example of the liquid-ejecting apparatus. Other examples of the liquid-ejecting apparatus are an apparatus provided with a coloring matter ejecting head for fabricating color filters for liquid crystal displays, an apparatus provided with an electrode forming material (conductive paste) ejecting head for forming electrodes for organic EL displays and field emission displays (FEDs), an apparatus provided with a bioorganic material ejecting head for manufacturing biochips, and an apparatus provided with a sample ejecting head as a precision pipette.

The ink-jet recording apparatus, which is a representative liquid-ejecting apparatus, is used prevalently nowadays for printing operations including color printing operations because the ink-jet recording apparatus generates comparatively low noise during a printing operation and is capable of forming small dots in a high dot density.

A liquid supply system for supplying a liquid to the liquid-consuming apparatus represented by the ink-jet recording apparatus supplies the liquid from a liquid container holding the liquid to the liquid-consuming apparatus. Generally, the liquid container used by the liquid supply system is a cartridge capable of detachably attached to the liquid-consuming apparatus to facilitate the user's work for replacing the liquid container with a new one when the liquid contained in the liquid container is exhausted.

Generally, the ink-jet recording apparatus is provided with a carriage carrying a recording head that ejects ink drops and capable of reciprocating along the recording surface of a recording medium. An ink supply system for supplying ink from an ink cartridge to a recording head mounts the ink cartridge on a carriage and supplies the ink from the ink cartridge to a recording head while the ink cartridge is reciprocated together with the recording head. Another ink supply system mounts an ink cartridge on the case or the like of the body of an apparatus, and carries ink from the ink cartridge to a recording head by a flexible tube or the like forming an ink passage.

Recently, the pigment ink is used prevalently for printing high-quality, highly weatherproof images. Although the pigment ink is capable of printing images excellent in print quality, pigment particles of the pigment ink contained in an ink container sediment so that pigment content is distributed unevenly in the ink container. Consequently, the ink-jet recording apparatus is unable to print images in an expected print accuracy after the ink-jet recording apparatus has been kept inoperative for a long time.

An ink-jet recording apparatus proposed in JP-A 60-110458 (Patent document 1) is provided with an ink stirring mechanism including a rotor and a magnetic stirrer. An ink-jet recording apparatus proposed in JP-A 11-10902 (Patent document 2) includes a main tank provided with a stirring member and a stirring bar, a subtank connected to the main tank by an ink circulating line. These mechanisms proposed in Patent documents 1 and 2 are intended to prevent the uneven distribution of pigment content by forcibly stirring the ink held in the ink container.

These mechanisms proposed in Patent documents 1 and 2 need a device including a complicated mechanism, such as the stirrer, and power for driving the complicated mechanism and, consequently, the construction of the recording apparatus is inevitably complicated. The magnetic stirrer and a stirrer driving unit, namely, driving devices for rotating the rotor and the stirring member, need to be disposed near the ink container, which places restrictions on the configuration of the recording apparatus and the recording apparatus is inevitably large.

SUMMARY OF THE INVENTION

The present invention has been made in view of the foregoing problems and it is therefore an object of the present invention to provide a liquid container which makes the construction of a liquid-consuming apparatus into which the liquid container is incorporated neither complicated nor large and can prevent the uneven distribution of ingredient concentration.

To solve the problems, the present invention provides a liquid container holding a liquid to be supplied to a liquid-consuming apparatus, including: a liquid pack including a flexible pouch formed of a flexible material and holding the liquid; a container body for containing the liquid pack; an expandable-and-contractile stirring chamber formed in the container body; and a pressurized fluid supply passage for supplying a pressurized fluid into the stirring chamber; wherein at least a part of the stirring chamber is formed of a low-rigidity member having a low rigidity, and the low-rigidity member is deformed by supplying the pressurized fluid into the stirring chamber through the pressurized fluid supply passage to press and deform the flexible pouch of the liquid pack by the low-rigidity member.

Preferably, the low-rigidity member of the stirring chamber presses and deforms a part of the flexible pouch of the liquid pack.

Preferably, the low-rigidity member includes a flexible film.

Preferably, the stirring chamber is formed by attaching the flexible film of a predetermined shape to an inner wall surface of the container body.

Preferably, the pressurized fluid supply passage is formed by sealing a groove formed in an inner surface of the container body with the flexible film.

Preferably, the stirring chamber has an open passage communicating with an interior space of the container body surrounding the stirring chamber, and the open passage exerts a resistance against flow of the pressurized fluid to generate a pressure sufficient to press and deform the flexible pouch of the liquid pack when the pressurized fluid is supplied into the stirring chamber.

Preferably, the open passage is formed by sealing a groove formed in the inner surface of the container body with a film.

Preferably, an interior of the container body is a sealed space, and the liquid is discharged by pressing the liquid pack by pressure of the pressurized fluid supplied through the open passage.

Preferably, the liquid container further includes a pressure chamber containing the liquid pack and formed to press the liquid pack by the pressurized fluid supplied into the pressure chamber, and the stirring chamber is formed in the pressure chamber.

Preferably, the liquid container further includes a connecting passage connecting the stirring chamber and the pressure chamber to carry the pressurized fluid supplied through the pressurized fluid supply passage into the stirring chamber to the pressure chamber. A resistance against the flow of the pressurized fluid flowing through the connecting passage is higher than a resistance against the pressurized fluid flowing through the pressurized fluid supply passage.

Preferably, the stirring chamber is disposed so as to press a lower part, with respect to a direction in which gravity acts, of the flexible pouch of the liquid pack while the liquid container is in use.

Preferably, the liquid container further includes a stirring bar placed in the flexible pouch to enhance a stirring effect of flow of the liquid in the flexible pouch of the liquid pack caused by a deformation of the low-rigidity member of the stirring chamber.

Preferably, the stirring bar is disposed near a part, which is to be deformed by the low-rigidity member of the stirring chamber when the low-rigidity member is deformed, of the flexible pouch of the liquid pack.

Preferably, the stirring bar is disposed above a part, which is to be deformed by the low-rigidity member of the stirring chamber when the low-rigidity member is deformed, of the flexible pouch of the liquid pack.

Preferably, the liquid pack is provided with a spout through which the liquid contained in the liquid pack is discharged, and the stirring bar has one end fixed to the spout.

Preferably, the liquid container is a liquid cartridge which is configured to be detachably attached to a container holding part of the liquid-consuming apparatus.

The liquid container according to the present invention having the above-mentioned characteristic features makes the construction of the liquid-consuming apparatus to which the liquid container is mounted neither complicated nor large, and can prevent the uneven distribution of ingredient concentration in the liquid held in the liquid container.

BRIEF DESCRIPTION OF THE DRAWINGS

The above and other objects, features and advantages of the present invention will become apparent from the following description taken in connection with the accompanying drawings, in which.

DESCRIPTION OF THE PREFERRED EMBODIMENTS

An ink cartridge, namely, a liquid container, for an ink-jet recording apparatus in a preferred embodiment according to the present invention will be described with reference to the accompanying drawings.

First, an ink-jet recording apparatus provided with the ink cartridge embodying the present invention will be described with reference to FIG. 1.

Figure 1:
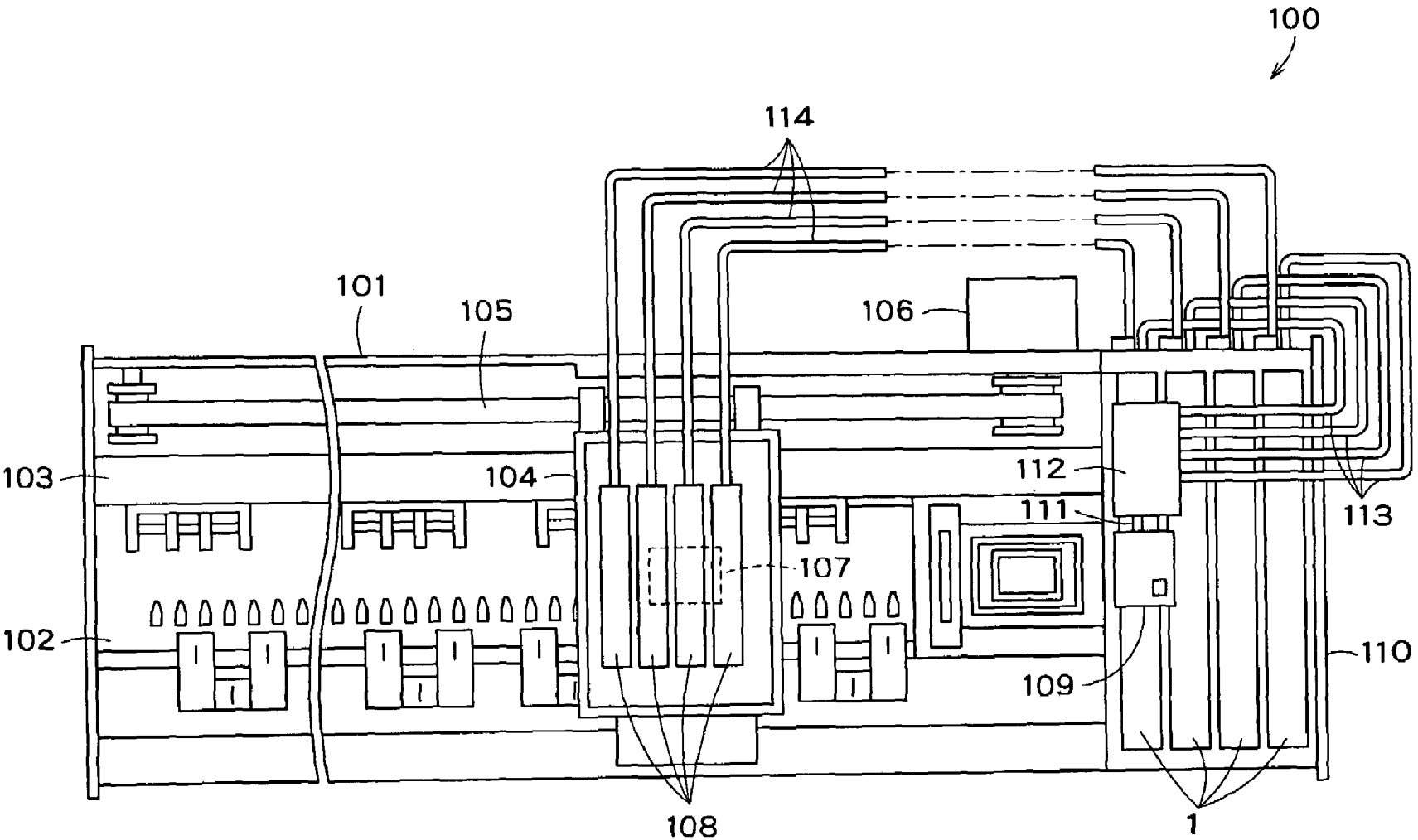
FIG. 1 is a plan view of an ink-jet recording apparatus provided with an ink cartridge in a preferred embodiment according to the present invention.

Referring to FIG. 1, an ink-jet recording apparatus 100 has a main case 101, a platen 102, a guide rod 103, a carriage 104, a timing belt 105, a carriage driving motor 106, and a recording head 107, namely, a liquid ejecting head. The ink-jet recording apparatus 100 is provided with valve units 108 and a pressurizing pump 109.

The main case 101 is a box of a shape substantially resembling a rectangular solid. The main case 101 is provided with a cartridge holder 110 in a right end part, as viewed in FIG. 1, thereof. Four ink cartridges 1, namely, liquid containers, in a preferred embodiment according to the present invention, are detachably mounted on the cartridge holder 110. The four ink cartridges 1 contain a black ink, a yellow ink, a magenta ink, and a cyan ink, respectively.

The platen 102 is extended parallel to a scanning direction in which the recording head 107 moves in the main case 101. The platen 102 supports a recording medium, not shown, fed by a paper feed means, not shown. The recording medium is fed in a feed direction perpendicular to the scanning direction.

The guide rod 103 having the shape of a bar is extended parallel to the scanning direction parallel to the platen 102 in the main case 101. The guide rod 103 penetrates the carriage 104 so that the carriage 104 is slidable on the guide rod 103 to guide the carriage 104 disposed opposite to the platen 102 for reciprocation in directions parallel to the scanning direction.

The carriage driving motor 106 is interlocked with the carriage 104 by the timing belt 105. The carriage driving motor 106 is supported on the main case 101. The carriage driving motor 106 operates to drive the carriage 104 through the timing belt 105 for reciprocation along the guide rod 103 in directions parallel to the scanning direction.

The recording head 107 is provided with a plurality of nozzles to eject ink drops toward the platen 102. The valve units 108 are mounted on the carriage 104. The valve units 108 hold the inks temporarily, adjust the pressures of the inks and supply the inks of adjusted pressures to the recording head 107. This ink-jet recording apparatus 100 is provided with four valve units 108 respectively for the black ink, the yellow ink, the magenta ink and the cyan ink.

The pressurizing pump 109 is connected to a pressure measuring device 112 by a connecting tube 111. Air supply tubes 113 connect the pressure measuring device 112 to the ink cartridges 1, respectively. The ink cartridges 1 are connected to the valve units 108 by ink supply tubes 114, respectively.

An ink cartridge 1 in a preferred embodiment according to the present invention will be described with reference to FIGS. 2A to 9C.

Figure 2A:
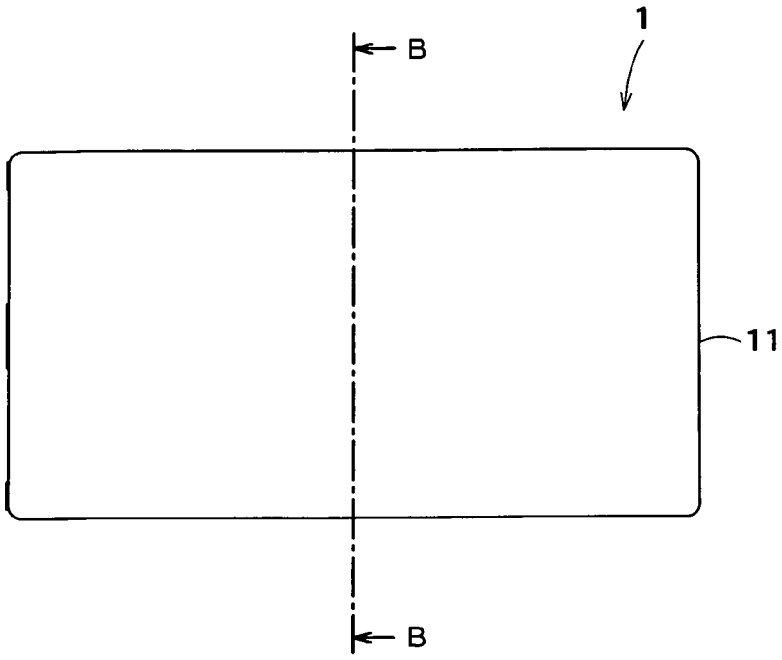
FIGS. 2A, 2B and 2C are a side elevation, a sectional view take on the line B-B in FIG. 2A and a side elevation of an essential part of a container body, respectively, of the ink cartridge in the preferred embodiment.
Figure 2B:
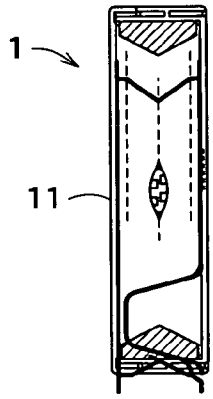
Figure 2C:
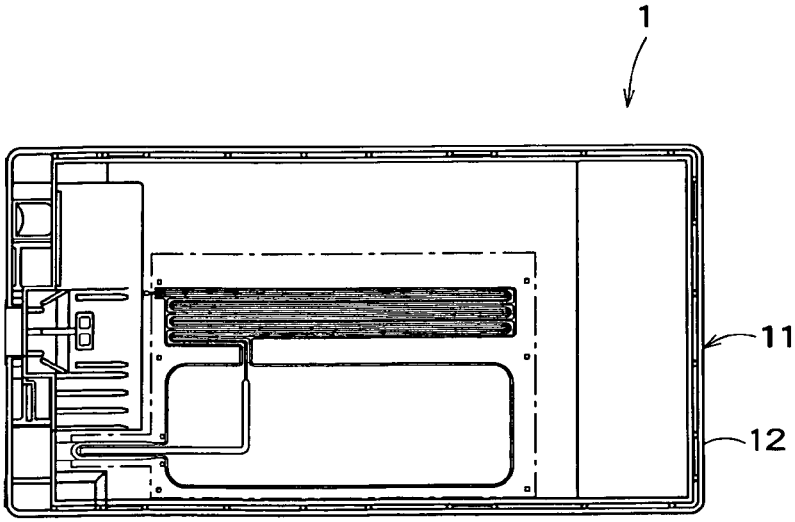
Figure 3:
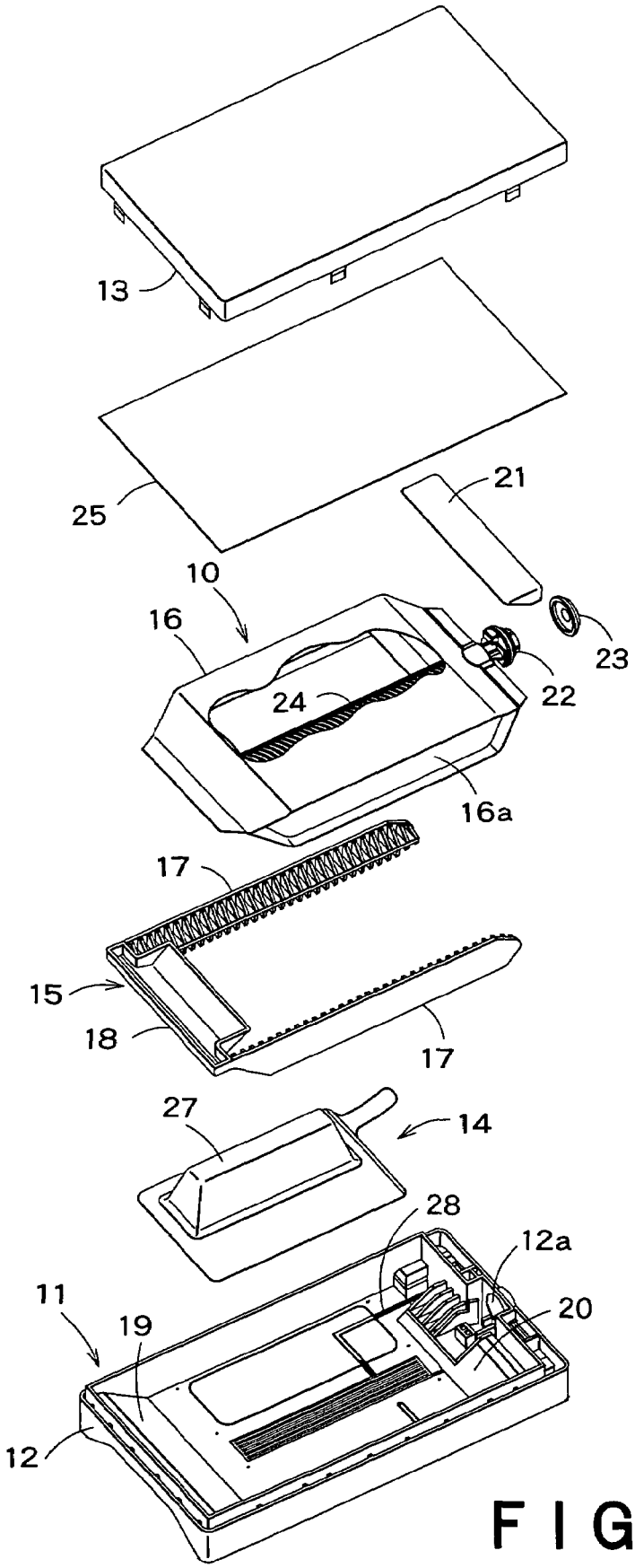
FIG. 3 is an exploded perspective view of the ink cartridge shown in FIGS. 2A to 2C.
Figure 4:
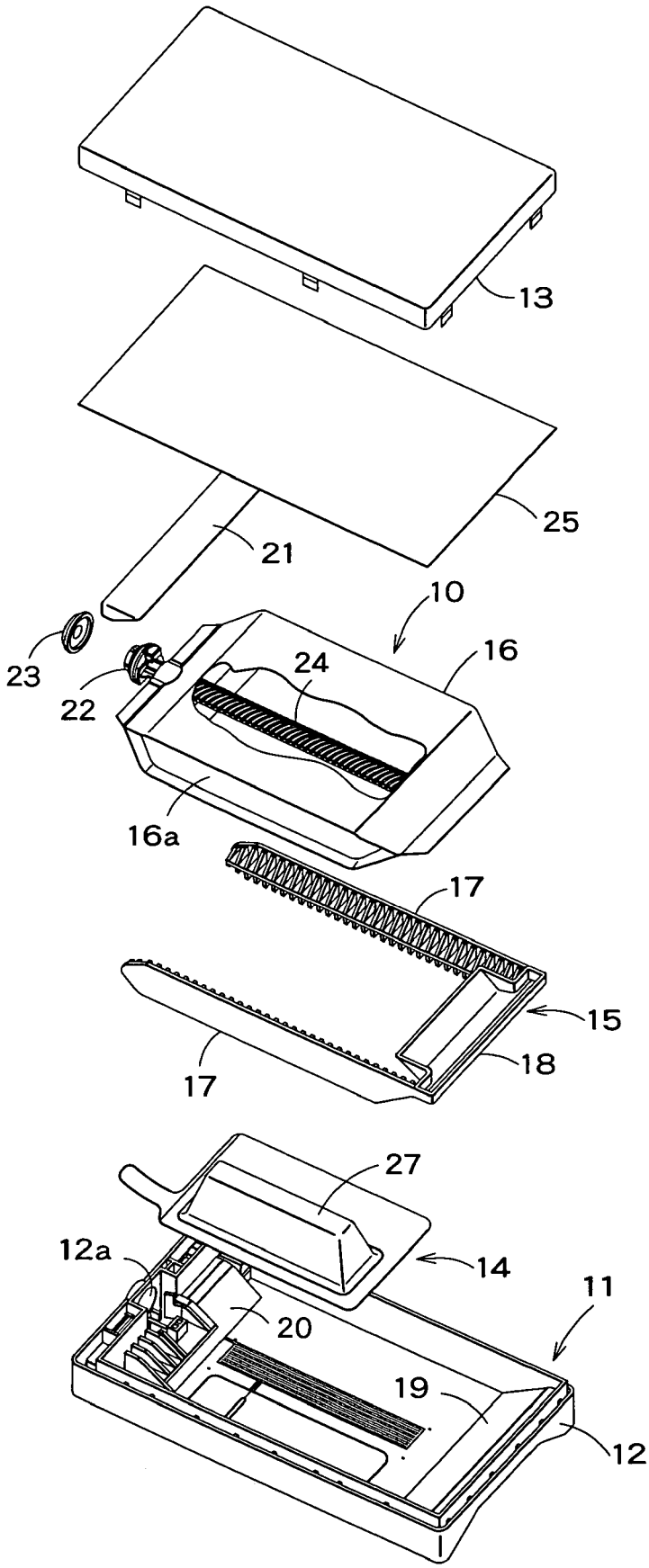
FIG. 4 is an exploded perspective view of the ink cartridge shown in FIGS. 2A to 2C, taken from a direction different from that from which the exploded perspective view shown in FIG. 3 is taken.

The ink cartridge 1 includes a container body 11 having the shape of a rectangular solid as shown in FIGS. 2A to 2C. As shown in FIGS. 3 and 4, the container body 11 has a main member 12 having one open side, and a cover 13 for hermetically covering the open side of the main member 12.

A formed film member 14 is attached to the inner surface of the main member 12. The formed film member 14 is formed of a film and has a solid part of a predetermined three-dimensional shape and a flat part of a predetermined planar shape. A U-shaped member 15 substantially resembling the letter U and an ink pack 10 are contained in the container body 11. The ink pack 10 includes a flexible pouch 16 holding the ink.

Figure 8A:
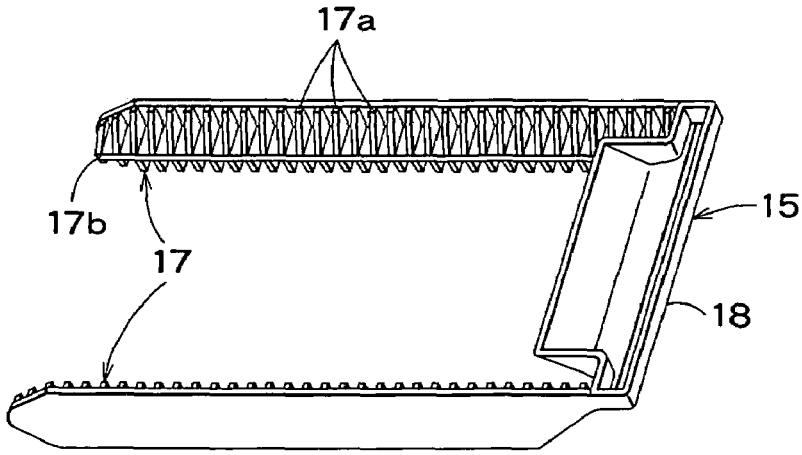
FIGS. 8A, 8B and 8C are views of a U-shaped member included in the ink cartridge shown in FIGS. 2A to 2C, taken from different angles, respectively.
Figure 8B:
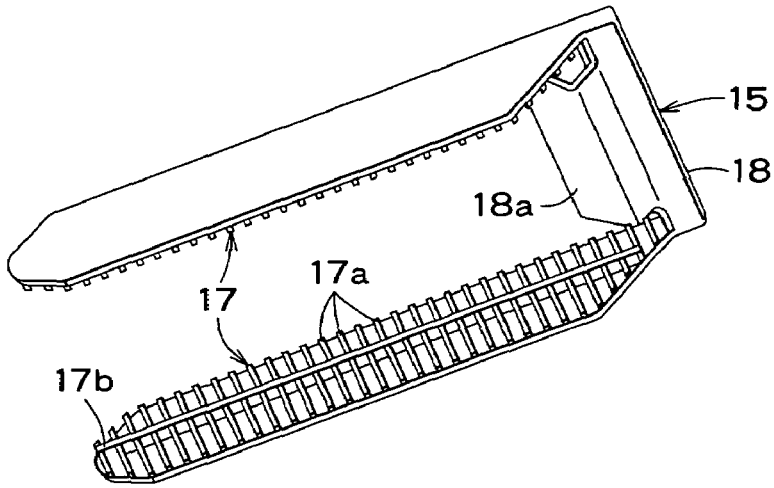
Figure 8C:
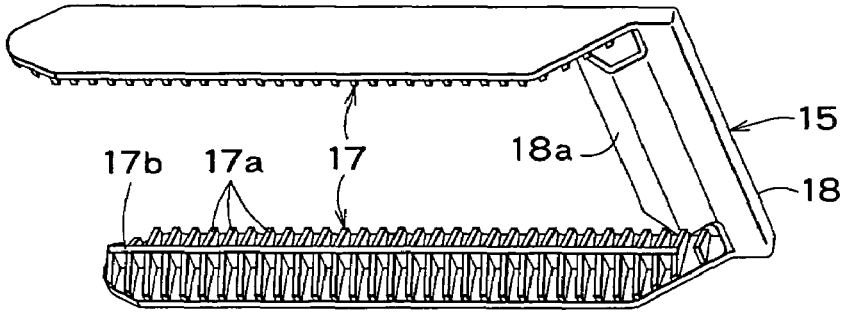

As shown in FIGS. 8A to 8C, the U-shaped member 15 has a pair of restricting parts 17 and a holding cross bar 18 having opposite ends connected to the restricting parts 17. The restricting parts 17 are in contact with bent walls 16*a* (FIGS. 3 and 4), which bend as the ink contained in the ink pack 10 is consumed, of the flexible pouch 16 to restrict the bent walls 16*a* from bending outward and to make the bent walls 16*a* bend inward. The restricting parts 17 extend substantially over the overall length of the flexible pouch 16 of the ink pack 10 in the back-and-forth direction.

Figure 6A:
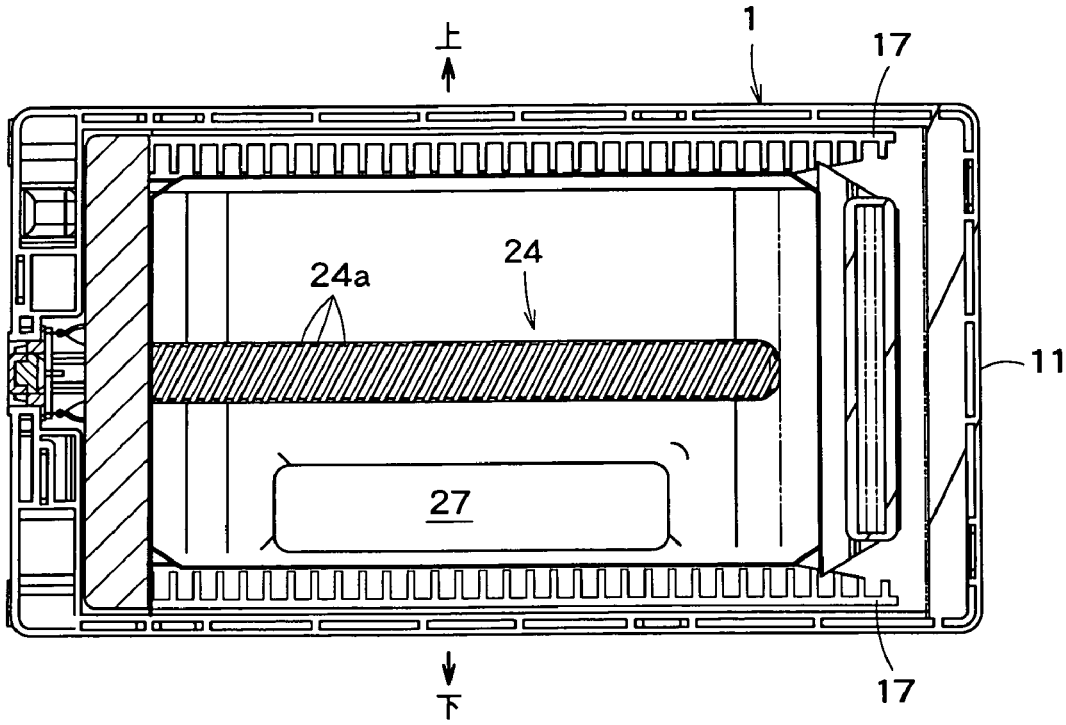
FIGS. 6A, 6B and 6C are a vertical sectional view, a sectional plan view of a section in a plane including a spout, and a sectional plan view of a stirring chamber in an expanded state, respectively, of the ink cartridge shown in FIGS. 2A to 2C.
Figure 6B:
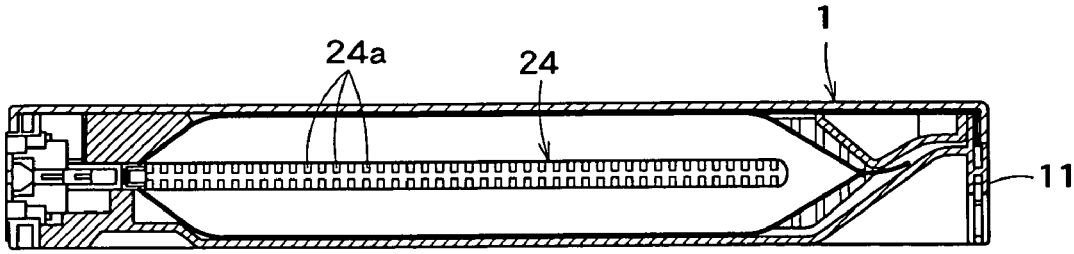
Figure 6C:
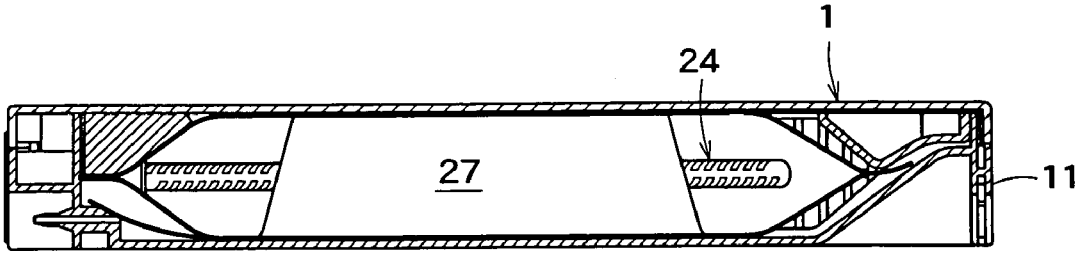
Figure 7:
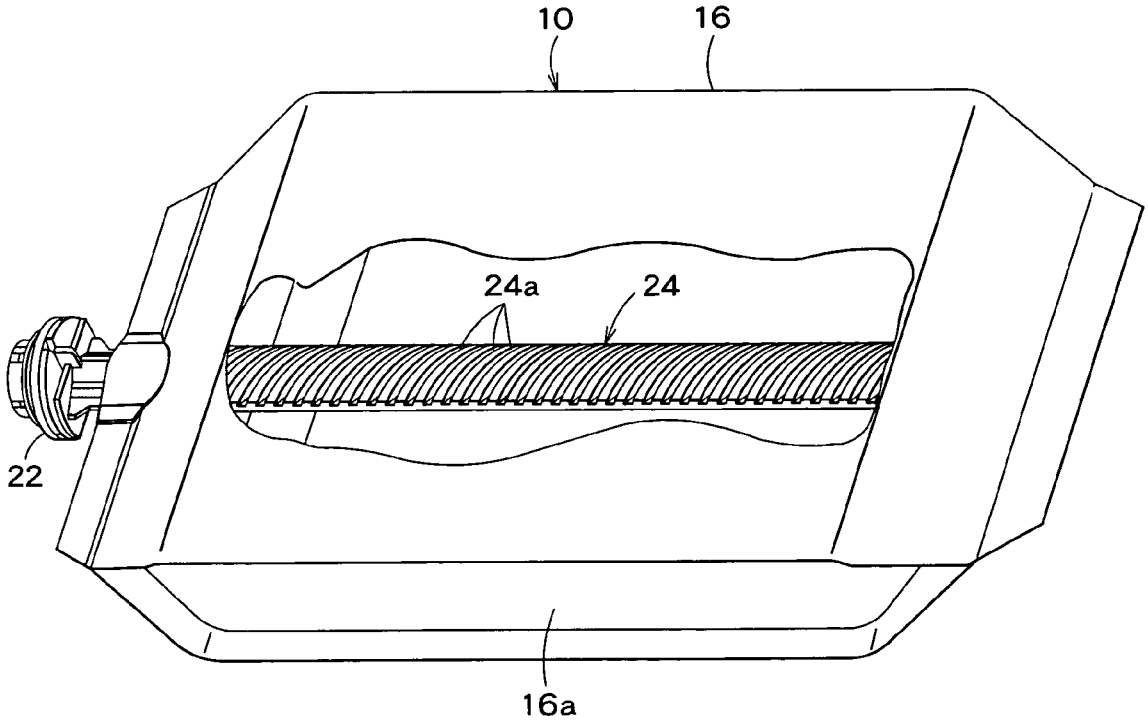
FIG. 7 is a partly cutaway perspective view of an ink pack included in the ink cartridge shown in FIGS. 2A to 2C.
Figures 9A, 9B, 9C:
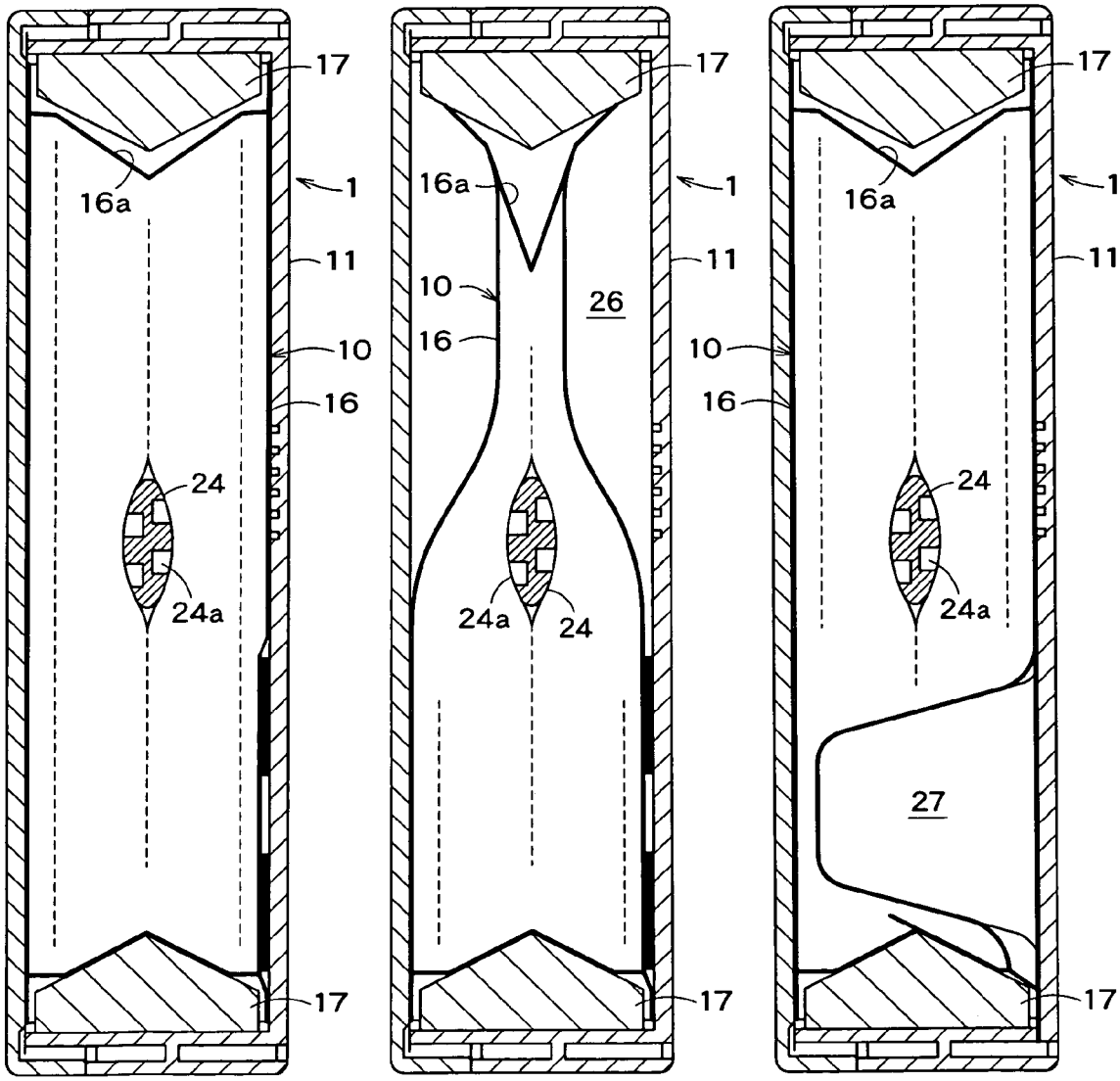
FIGS. 9A, 9B and 9C are sectional views of the ink cartridge shown in FIGS. 2A to 2C in a state where the ink cartridge is fully filled with the ink, a state where the ink cartridge is not pressed and the ink is being consumed and a state where the ink cartridge is pressed and the ink is being consumed, respectively.

As shown in FIGS. 6A and 9C, each of the restricting parts 17 has a width substantially corresponding to the thickness of an interior space in the container body 11 and has a length substantially corresponding to the overall length of the container body 11 in the back-and-forth direction. As shown in FIGS. 8A to 8C, each restricting part 17 is provided with a plurality of triangular ribs (transverse contact parts) 17*a* and a longitudinal, straight rib (longitudinal contact part) 17*b*. The triangular ribs 17*a* come into linear contact with the bent wall 16*a* of the flexible pouch 16 of the ink pack 10 along the entire thickness of the flexible pouch 16. The longitudinal, straight rib 17*b* comes into contact with the bent wall 16*a* of the flexible pouch 16 along a straight line in the back-and-forth direction of the ink pack 10.

Referring to FIGS. 3 and 4, a holding slope 19 is formed in the back end of the space in the main member 12. A tapered back end part of the flexible pouch 16 of the ink pack 10 is held between the holding slope 19 and a sloping part 18*a* (FIGS. 8B and 8C) of the holding cross bar 18 of the U-shaped member 15 to secure a back part of the ink pack 10. A holding slope 20 is formed in the front end of the space in the main member 12. A tapered front end part of the flexible pouch 16 of the ink pack 10 is held between the holding slope 20 and the sloping surface of a front holding member 21 disposed in a front part of the space in the container body 11 to secure a front part of the ink pack 10.

As shown in FIGS. 3 and 4, a spout 22 is attached to the front end of the flexible pouch 16. The spout 22 is fitted in an opening 12*a* formed in the front wall of the main member 12 of the container body 11. A gap between the spout 22 and the side surface of the opening 12*a* is sealed by a sealing member 23. The ink contained in the ink pack 10 is discharged through the spout 22.

Figure 5A:
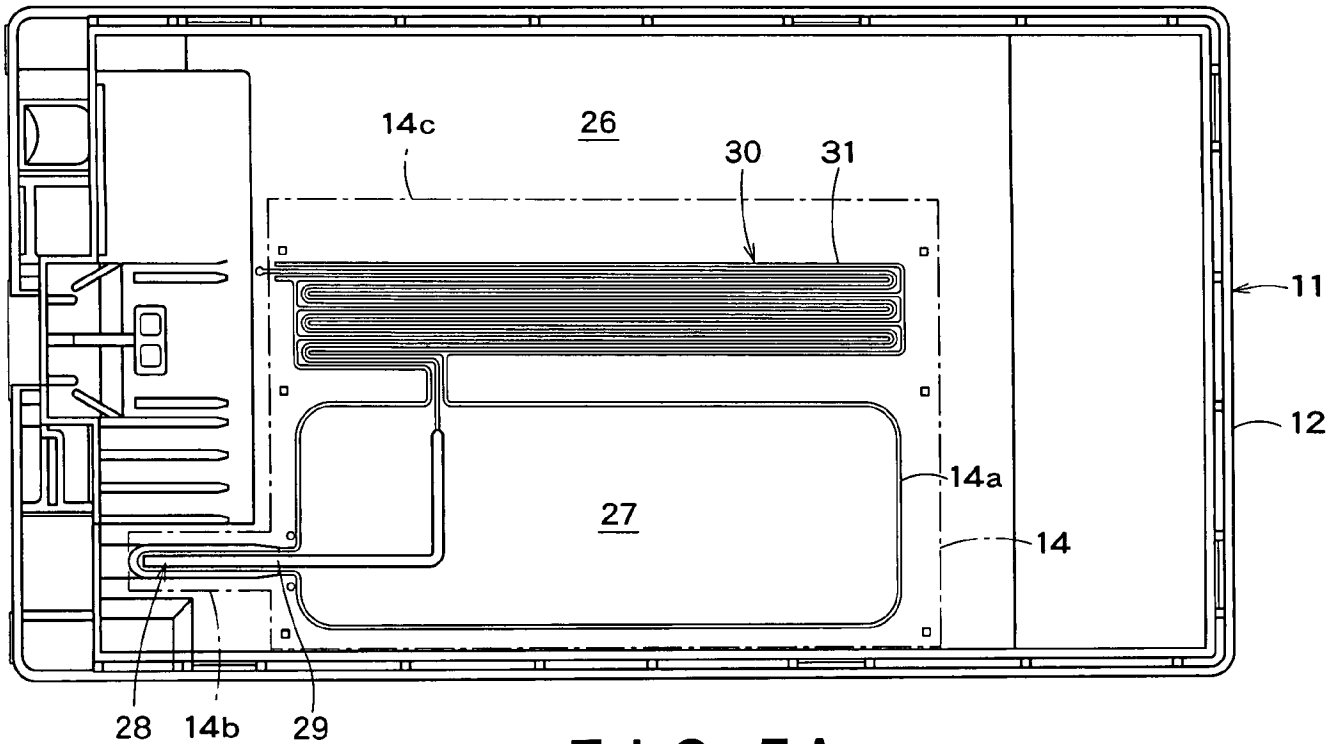
FIGS. 5A and 5B are an enlarged side elevation of an essential part of the container body of the ink cartridge shown in FIGS. 2A to 2C and a plan view of a section in a plane including a compressed air supply passage, respectively.
Figure 5B:
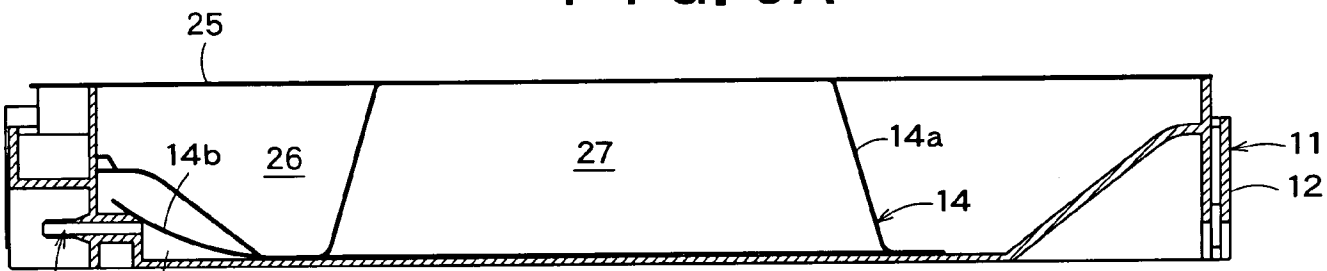

The open side of the main member 12 is hermetically covered with a film 25 to form a pressure chamber 26 in the container body 11 as shown in FIGS. 5A and 5B. The recording apparatus supplies compressed air into the pressure chamber 26 to compress the flexible pouch 16 of the ink pack 10 to deliver the ink held in the ink pack 10 to the recording apparatus.

As shown in FIGS. 5A and 5B, a protrusion (low-rigidity member) 14*a* of the formed film member 14 defines an expandable-and-contractile stirring chamber 27 in the pressure chamber 26. A compressed air supply passage 28 is formed to extend from an outer wall surface of the container body 11 to the inside thereof, so as to supply compressed air into the stirring chamber 27. A part of the compressed air supply passage 28 is formed by sealing a groove 29 formed in the inner surface of a wall of the main member 12 of the container body 11 with a projecting part 14*b* of the formed film member 14.

The stirring chamber 27 communicates with the pressure chamber 26 by means of an open passage 30. The open passage 30 is formed by sealing a groove 31 formed in the inner surface of the wall of the main member 12 of the container body 11 with a flat part 14*c* of the formed film member 14. The groove 31 forming the open passage 30 exerts a resistance against the flow of compressed air supplied into the stirring chamber 27 so that a pressure capable of compressing and deforming the flexible pouch 16 of the ink pack 10 is generated in the stirring chamber 27. More specifically, the groove 31 forming the open passage 30 has a narrow width and is formed like a labyrinth as shown in FIG. 5A. Thus resistance exerted by the open passage 30 against the flow of the compressed air is higher than that exerted by the compressed air supply passage 28 against the flow of the compressed air.

As shown in FIG. 5A, compressed air can be surely supplied into the stirring chamber 27 through the compressed air supply passage 28 in a state where the stirring chamber 27 is fully compressed by the ink pack 10 fully filled up with the ink because the groove 29 defining the compressed air supply passage 28 is extended and connected to the entrance of the open passage 30 in the stirring chamber 27.

Referring to FIGS. 6A to 6C and 7, a stirring bar 24 is placed in the flexible pouch 16 of the ink pack 10 and the front end of the stirring bar 24 is fixed to the spout 22. The stirring bar 24 is provided with many slant grooves 24*a* to enhance the stirring effect of the stirring bar 24. As shown in FIG. 6A, the stirring chamber 27 is disposed in a lower part of the container body 11 so as to press a lower part, with respect to a direction in which gravity acts, of the flexible pouch 16 of the ink pack 10 while the ink cartridge 1 is in use. The stirring bar 24 is disposed near and above a part, which is to be deformed due to the deformation of the stirring chamber 27, of the flexible pouch 16 of the ink pack 10.

Functions of the ink cartridge 1 in this embodiment will be described with reference to FIGS. 9A to 9C.

FIG. 9A shows the ink pack 10 fully filled with the ink of a new ink cartridge 1. When the ink pack 10 is fully filled with the ink, the ink pack 10 maintains the same shape both in a pressurized state where compressed air is supplied into the container body 11 and an unpressurized state where compressed air is not supplied into the container body 11.

From a state shown in FIG. 9A, as the ink is consumed and the quantity of the ink contained in the ink pack 10 decreases, the thickness of an upper part of the flexible pouch 16 of the ink pack 10 decreases as shown in FIG. 9B where no compressed air is supplied into the container body 11.

When the pressurizing pump 109 is actuated to supply compressed air through the compressed air supply passage 28 into the stirring chamber 27 in a state shown in FIG. 9B, the stirring chamber 27 expands so as to bulge out toward the flexible pouch 16 of the ink pack 10 as shown in FIG. 9C. Consequently, a lower part of the flexible pouch 16 of the ink pack 10 is pressed and partially deformed and the ink contained in the flexible pouch 16 is caused to flow and is stirred. The stirring bar 24 disposed near and above the part of the flexible pouch 16 deformed by the expanded stirring chamber 27 disturbs the flow of the ink in the flexible pouch 16 to enhance the stirring effect of the flow of the ink.

The compressed air supplied into the stirring chamber 27 flows through the open passage 30 into the pressure chamber 26. Consequently, the flexible pouch 16 of the ink pack 10 is compressed and the ink can be urged to flow from the ink cartridge 1 toward the recording apparatus.

Thus, at the start of the printing operation of the recording apparatus, the stirring chamber 27 is expanded to carry out an automatic stirring operation for stirring the ink contained in the flexible pouch 16, before the flexible pouch 16 of the ink pack 10 of the ink cartridge 1 in this embodiment is compressed to supply the ink to the recording apparatus. Since compressed air is not supplied to the stirring chamber 27 while the recording apparatus is not in operation, unnecessary compression of the flexible pouch 16 of the ink pack 10 can be avoided while the recording apparatus is not in operation. The construction of the recording apparatus can be simplified by using a common pressure source for both pressing the ink pack 10 and expanding the stirring chamber 27.

The stirring operation by the expansion of the stirring chamber 27 may be performed not only at the start of the printing operation, but also at any suitable time when necessary.

The pressurizing pump 109 may be capable of alternately performing a discharge operation and a suction operation to make the stirring chamber 27 perform expansion and contraction alternately.

As apparent from the foregoing description, the ink cartridge 1 in this embodiment is capable of surely preventing the uneven distribution of ingredient concentration in the ink contained therein without intensifying the structural complicacy of the ink-jet recording apparatus and without enlarging the ink-jet recording apparatus. When a pigment ink is used for printing, the ink cartridge 1 is particularly effective in preventing the uneven sedimentation of the pigment particles in the ink cartridge 1.

As obvious from FIG. 9B, the upper bent wall 16*a* of the flexible pouch 16 of the ink pack 10 bends as the ink contained in the ink pack 10 is consumed. The restricting part 17 restricts the bending of the upper bent wall 16*a* so that the upper bent wall 16*a* surely bends inward. Thus it is possible to prevent the outward bending of the bent wall 16*a* of the flexible pouch 16 and resultant increase in resistance against the bending of the bent wall 16*a*, and increase in the quantity of the ink that is unused and remains in the ink pack 10.

Since the triangular ribs 17*a* of the restricting part 17 are in contact with the bent wall 16*a* of the flexible pouch 16 of the ink pack 10 over the entire width of the bent wall 16*a* in the direction of the thickness of the bent wall 16*a*, the concentration of impulsive force on the folding line of the bent wall 16*a* can be avoided when the flexible pouch 16 of the ink pack 10 is compressed, and the restricting parts 17 are able to hold the ink pack 10 securely in place in the container body 11.

Particularly, in the ink cartridge 1 in this embodiment, the bent walls 16*a* of the flexible pouch 16 of the ink pack 10 are pressed against the restricting parts 17 when the stirring chamber 27 is expanded for a stirring operation. Then, it is very effective to avoid the concentrated, repetitive application of impulsive force on the bent walls 16*a*.

Unification of the restricting parts 17 and the holding cross bar 18 in a single member reduces the number of parts.

The flexible pouch 16 of the ink pack 10 of the ink cartridge 1 in this embodiment is compressed by compressed air when the recording apparatus operates for printing. An ink cartridge provided with an ink pack that is not compressed when the recording apparatus operates for printing may be provided with the foregoing stirring mechanism and restricting parts.

An ink cartridge in a modification of the ink cartridge 1 in the preferred embodiment will be described with reference to FIG. 10.

Figure 10:
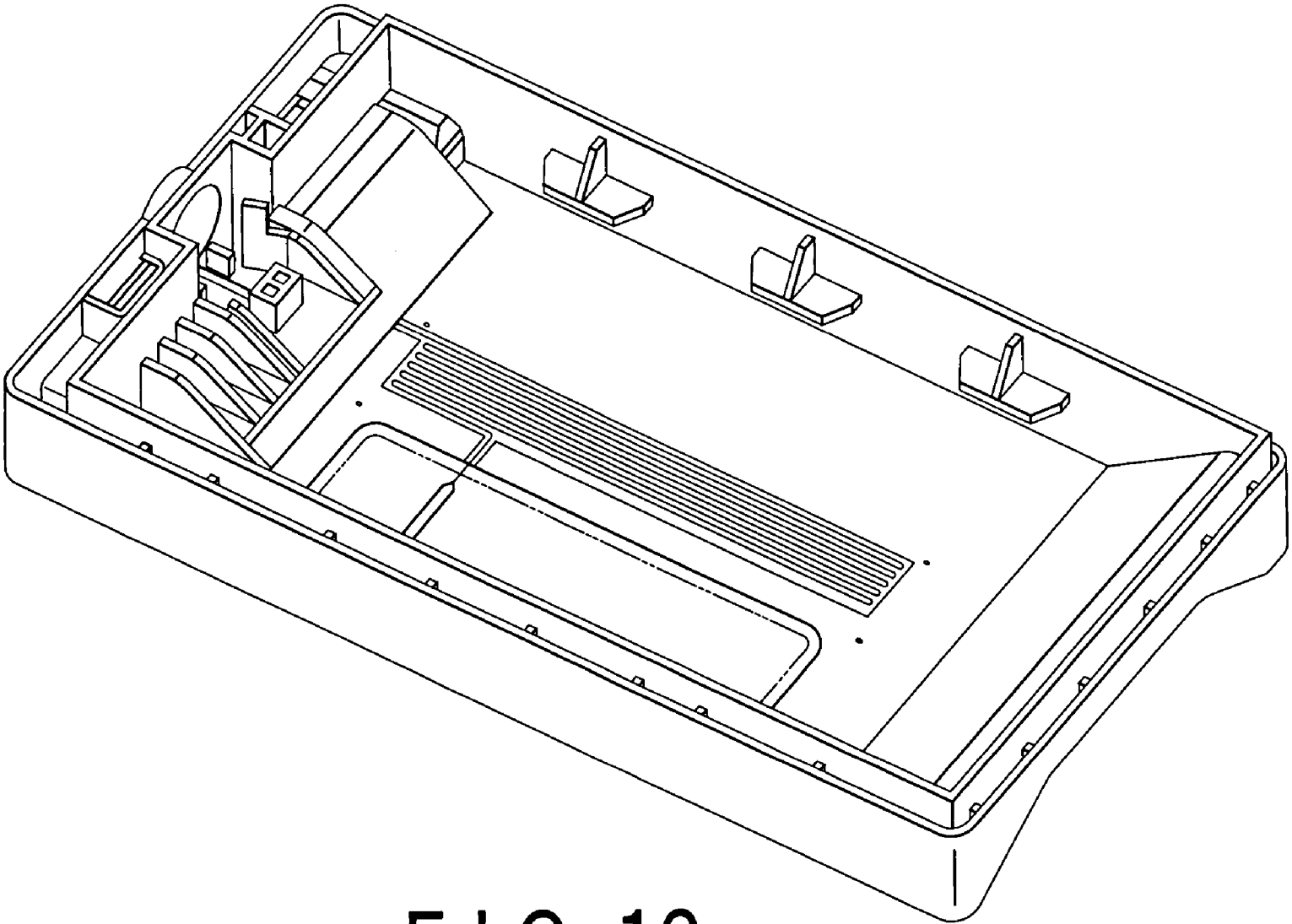
FIG. 10 is a perspective view of an essential part of a container body included in an ink cartridge in a modification of the ink cartridge shown in FIGS. 2A to 2C.
Figure 11:
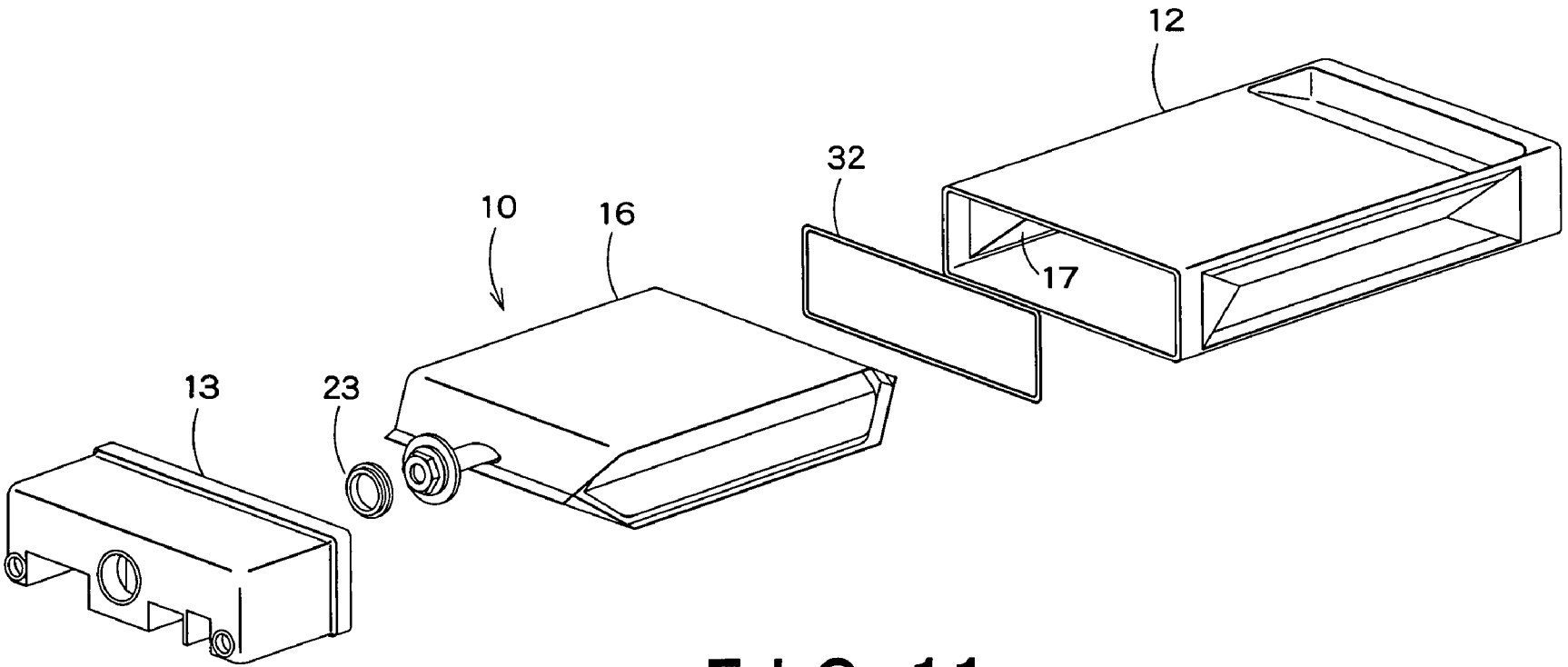
FIG. 11 is an exploded perspective view of an ink cartridge in another modification of the ink cartridge shown in FIGS. 2A to 2C.
Figure 12A:
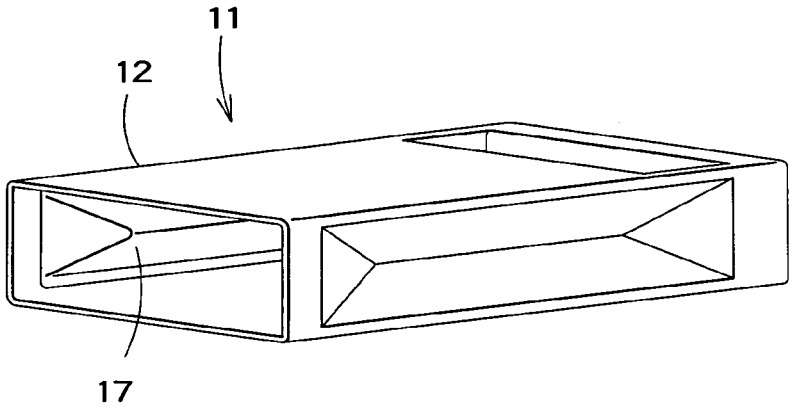
FIGS. 12A, 12B and 12C are a perspective view, a side elevation and a sectional view taken on the line A-A in FIG. 12B, respectively, of an essential part of the container body of the ink cartridge shown in FIG. 11.
Figure 12B:
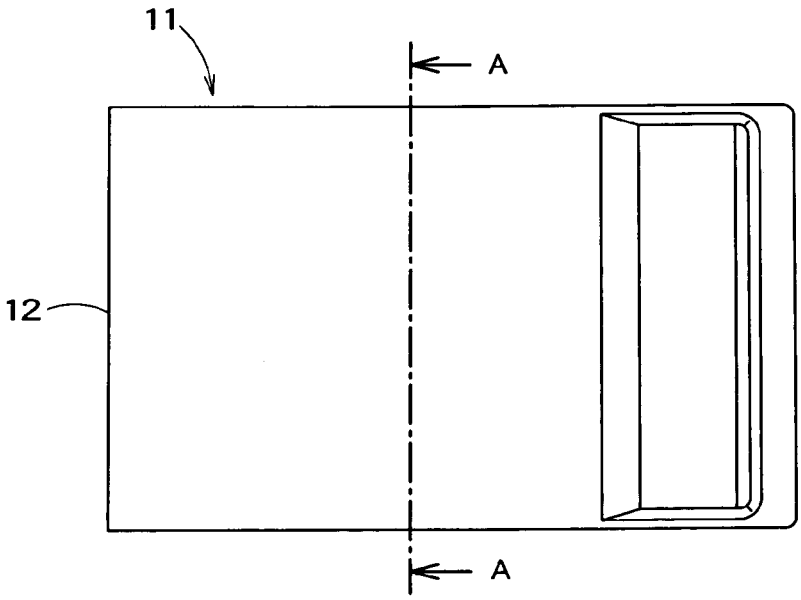
Figure 12C:
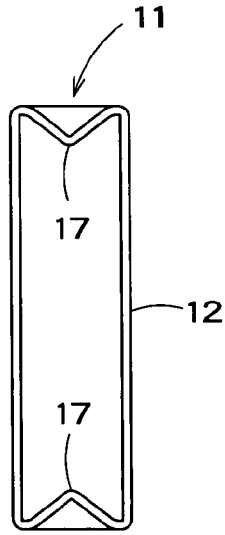
Figure 13A:
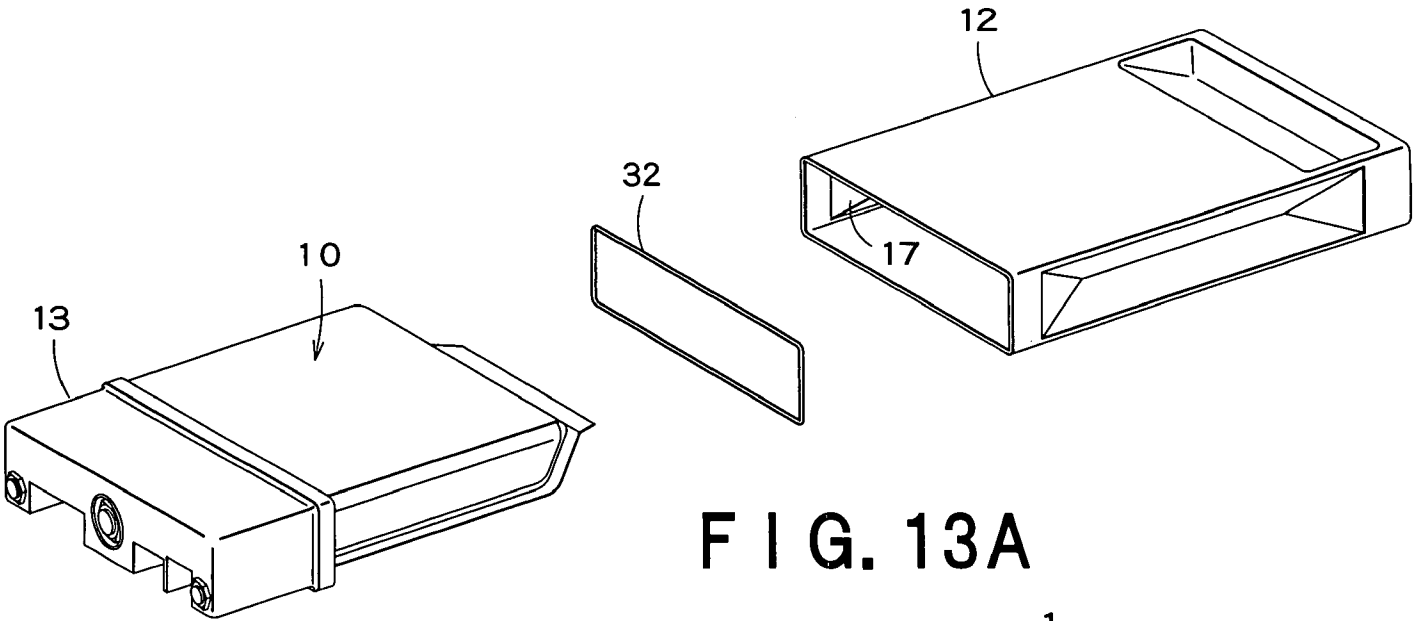
FIGS. 13A and 13B are perspective views of the ink cartridge shown in FIG. 11 in a state where the ink cartridge is being assembled and a state where the ink cartridge is completed, respectively.
Figure 13B:
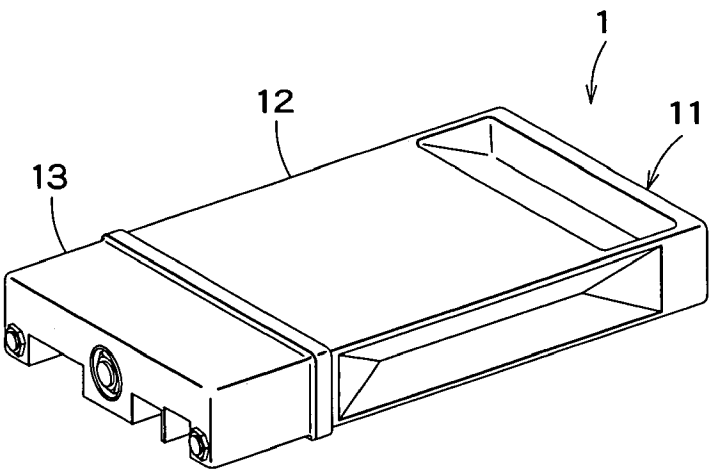

As shown in FIG. 10, restricting parts 17 are formed integrally with a container body 11. The restricting parts 17 are formed on the inner surface of a main member 12 included in the container body 11 at intervals along the length of an ink pack 10 in the back-and-forth direction. The restricting parts 17 are in contact with the bent wall 16 over substantially entire thickness of the flexible pouch 16 of the ink pack 10.

The ink cartridge in the modification is expected to have the same effect as that of the foregoing embodiment. Moreover, since the restricting parts 17 are formed integrally with the container body 11, the number of parts can be reduced and manufacturing processes can be simplified.

Referring to FIGS. 11 to 13B showing an ink cartridge in another modification, a container body 11 includes a main member 12 having an open front end and a cover 13 hermetically covering the open front end of the main member 12. An O-ring 32 is held between the main member 12 and the cover 13 to seal the container body 11. The modification does not need any member corresponding to the film 25 shown in FIGS. 3 and 4.

The upper and the lower walls of the main member 12 of the ink cartridge in the modification are bent inward so as to protrude into the interior of the main member 12 to form restricting parts 17 having a triangular cross section.

The ink cartridge in the modification is expected to have the same effect as that of the foregoing embodiment. Moreover, since the ink cartridge in the modification does not need any members corresponding to the film 25 and the restricting parts 17 separate from the main member 12 shown in FIGS. 3 and 4, the number of parts can be reduced and manufacturing processes can be simplified.

Although the invention has been described in terms of the preferred embodiments thereof with a certain degree of particularity, obviously many changes and variations are possible therein. It is therefore to be understood that the present invention may be practiced otherwise than as specifically described herein without departing from the scope and spirit thereof.

What is claimed is:

1. A liquid container holding a liquid to be supplied to a liquid-consuming apparatus, comprising:

a liquid pack including a flexible pouch formed of a flexible material and holding the liquid;

a container body for containing the liquid pack;

an expandable-and-contractile stirring chamber formed with the inner surface of the container body; and a pressurized fluid supply passage for supplying a pressurized fluid into the stirring chamber;

wherein at least a part of the stirring chamber is formed of a low-rigidity member having a low rigidity, and the low-rigidity member is deformed by supplying the pressurized fluid into the stirring chamber through the pressurized fluid supply passage to press and deform the flexible pouch of the liquid pack by the low-rigidity member, and wherein the low-rigidity member of the stirring chamber presses and deforms only a part of one side of the flexible pouch of the liquid pack.

2. The liquid container according to claim 1, wherein the low-rigidity member includes a flexible film.

3. The liquid container according to claim 2, wherein the stirring chamber is formed by attaching the flexible film of a predetermined shape to an inner wall surface of the container body.

4. The liquid container according to claim 3, wherein the pressurized fluid supply passage is formed by sealing a groove formed in an inner surface of the container body with the flexible film.

5. The liquid container according to claim 1, wherein the stirring chamber is disposed so as to press a lower part, with respect to a direction in which gravity acts, of the flexible pouch of the liquid pack while the liquid container is in use.

6. The liquid container according to claim 1 farther comprising a stirring bar placed in the flexible pouch to enhance a stirring effect of flow of the liquid in the flexible pouch of the liquid pack caused by a deformation of the low-rigidity member of the stirring chamber.

7. The liquid container according to claim 6, wherein the stirring bar is disposed near a part, which is to be deformed by the low-rigidity member of the stirring chamber when the low-rigidity member is deformed, of the flexible pouch of the liquid pack.

8. The liquid container according to claim 1, wherein the liquid container is a liquid cartridge which is configured to be detachably attached to a container holding part of the liquid-consuming apparatus.

9. A liquid container holding a liquid to be supplied to a liquid-consuming apparatus, comprising:

a liquid pack including a flexible pouch formed of a flexible material and holding the liquid;

a container body for containing the liquid pack;

an expandable-and-contractile stirring chamber formed with the inner surface of the container body; and a pressurized fluid supply passage for supplying a pressurized fluid into the stirring chamber;

wherein at least a part of the stirring chamber is formed of a low-rigidity member having a low rigidity, and the low-rigidity member is deformed by supplying the pressurized fluid into the stirring chamber through the pressurized fluid supply passage to press and deform the flexible pouch of the liquid pack by the low-rigidity member, and wherein the stirring chamber has an open passage communicating with an interior space of the container body surrounding the stirring chamber, and the open passage exerts a resistance against flow of the pressurized fluid to generate a pressure sufficient to press and deform the flexible pouch of the liquid pack when the pressurized fluid is supplied into the stirring chamber.

10. The liquid container according to claim 9, wherein the open passage is formed by sealing a groove formed in the inner surface of the container body with a film.

11. The liquid container according to claim 9, wherein an interior of the container body is a sealed space, and the liquid is discharged by pressing the liquid pack by pressure of the pressurized fluid supplied through the open passage.

12. The liquid container according to claim 11 further comprising a pressure chamber containing the liquid pack and formed to press the liquid pack by the pressurized fluid supplied into the pressure chamber, and the stirring chamber is formed in the pressure chamber.

13. The liquid container according to claim 12 farther comprising a connecting passage connecting the stirring chamber and the pressure chamber to carry the pressurized fluid supplied through the pressurized fluid supply passage into the stirring chamber to the pressure chamber;

wherein a resistance against the flow of the pressurized fluid flowing through the connecting passage is higher than a resistance against the pressurized fluid flowing through the pressurized fluid supply passage.

14. A liquid container holding a liquid to be supplied to a liquid-consuming apparatus, comprising:

a liquid pack including a flexible pouch formed of a flexible material and holding the liquid;

a container body for containing the liquid pack;

an expandable-and-contractile stirring chamber formed with the inner surface of the container body; and a pressurized fluid supply passage for supplying a pressurized fluid into the stirring chamber;

wherein at least a part of the stirring chamber is formed of a low-rigidity member having a low rigidity, and the low-rigidity member is deformed by supplying the pressurized fluid into the stirring chamber through the pressurized fluid supply passage to press and deform the flexible pouch of the liquid pack by the low-rigidity member, further comprising a stirring bar placed in the flexible pouch to enhance a stirring effect of flow of the liquid in the flexible pouch of the liquid pack caused by a deformation of the low-rigidity member of the stirring chamber, wherein the stirring bar is disposed near and above a part, which is to be deformed by the low-rigidity member of the stirring chamber when the low-rigidity member is deformed, of the flexible pouch of the liquid pack.

15. The liquid container according to claim 14, wherein the liquid pack is provided with a spout through which the liquid contained in the liquid pack is discharged, and the stirring bar has one end fixed to the spout.

* * * * *